US007021209B2

(12) United States Patent
Faist et al.

(10) Patent No.: US 7,021,209 B2
(45) Date of Patent: Apr. 4, 2006

(54) DEVICES FOR ADJUSTING THE CONTACT PRESSURE OF AN ADJUSTABLY MOUNTED CYLINDER

(75) Inventors: Bernd Klaus Faist, Ochsenfurt (DE); Wolfgang Otto Reder, Veitshöchheim (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 14 days.

(21) Appl. No.: 10/471,291

(22) PCT Filed: Jan. 19, 2002

(86) PCT No.: PCT/DE02/00167

§ 371 (c)(1),
(2), (4) Date: Dec. 19, 2003

(87) PCT Pub. No.: WO02/074542

PCT Pub. Date: Sep. 26, 2002

(65) Prior Publication Data

US 2004/0112232 A1 Jun. 17, 2004

(30) Foreign Application Priority Data

Mar. 20, 2001 (DE) ..... 101 13 313

(51) Int. Cl.
*B41F 5/00* (2006.01)
*B41F 31/00* (2006.01)

(52) U.S. Cl. ..... 101/216; 101/352.05

(58) Field of Classification Search ..... 101/216–218, 101/142, 177, 182, 247–248, 352.05, 352.01
See application file for complete search history.

(56) References Cited

U.S. PATENT DOCUMENTS

| | | | |
|---|---|---|---|
| 4,381,707 | A | 5/1983 | Klaus et al. |
| 4,455,727 | A | 6/1984 | Tschirner |
| 4,899,656 | A | 2/1990 | Thomas et al. |
| 5,003,863 | A | 4/1991 | Schiel et al. |
| 5,048,362 | A | 9/1991 | Becker et al. |
| 5,967,043 | A | 10/1999 | Mayr |
| 6,098,542 | A | 8/2000 | Dufour |

FOREIGN PATENT DOCUMENTS

| | | |
|---|---|---|
| DE | 24574 | 5/1960 |
| DE | 1 250 451 | 3/1968 |
| DE | 64064 | 10/1968 |
| DE | 1 561 014 | 2/1970 |
| DE | 1 807 751 | 3/1970 |
| DE | 27 36 175 | 2/1979 |
| DE | 30 46 989 C3 | 11/1987 |
| DE | 39 10 827 A1 | 11/1989 |
| DE | 38 20 026 A1 | 12/1989 |
| DE | 42 31 673 A1 | 3/1994 |
| DE | 197 30 681 A1 | 4/1998 |
| DE | 197 19 305 A1 | 11/1998 |
| DE | 199 19 733 A1 | 11/1999 |
| DE | 100 01 582 A1 | 8/2000 |
| DE | 200 11 948 U1 | 1/2001 |
| GB | 719289 | 12/1954 |
| GB | 1135901 | 1/1967 |
| GB | 1 213 903 | 11/1970 |
| GB | 1 223 506 | 2/1971 |
| GB | 2 271 082 A | 4/1994 |

*Primary Examiner*—Daniel J. Colilla
*Assistant Examiner*—Marissa Ferguson
(74) *Attorney, Agent, or Firm*—Jones Tullar & Cooper PC

(57) ABSTRACT

The contact pressure between an adjustably mounted first cylinder and a second cylinder in a printing machine, and particularly in a web-fed printing machine can be adjusted. An actuator is usable to force the first cylinder toward the second cylinder with an adjustable force. A fixing device is usable to fix the first cylinder in a desired position relative to the second cylinder.

30 Claims, 5 Drawing Sheets

DEVICES FOR ADJUSTING THE CONTACT PRESSURE OF AN ADJUSTABLY MOUNTED CYLINDER

FIELD OF THE INVENTION

The present invention is directed to devices for adjusting the contact pressure of a displaceably seated roller. The contact pressure is adjusted using at least one actuator. A fixation device can hold the roller in an adjusted position.

BACKGROUND OF THE INVENTION

A plurality of rollers are provided in conventional printing presses, for example in web-fed rotary printing presses. Inking rollers, in particular, are provided, which are used for transferring the ink from an ink reservoir to the plate cylinders. The ink transferred to the plate cylinders can be metered by the inking rollers, so that the ink is transferred as a uniform film of defined thickness. It is thus possible to even out interferences, such as speed fluctuations and rotary oscillations, for example.

Moreover, dampening unit rollers, which transfer a dampening agent, for example water, to the printing group, can also be provided in the printing press.

Pairs of rollers are often formed by rollers which are in engagement with each other, wherein at least one of the rollers has a cylinder surface made of an elastic material, so that this cylinder surface can be at least slightly deformed as a function of the contact pressure of the oppositely located roller. The result of the elastic deformation of the roller surface is a contact area extending in a straight line between the rollers, which contact area is called a contact strip. The width of the contact strip can be varied by adjusting the contact pressure between the rollers, wherein the width of the contact strip has a considerable effect on the printing result. If, for example, the contact strip in an inking unit is too narrow, not enough ink is transferred, while in the situation in which the contact strip is too broad, the elastic roller can be damaged by the roller's flexing.

In order to be able to adjust the strip width, in particular as a function of the respective operating conditions, for example the temperature of the printing presses, or the degree of their wear, it is necessary to adjustably seat one of the rollers so that it can be pushed in the direction of the opposite roller, by the use of an actuator, with an adjustable force. Once the correct contact pressure between the two rollers has been established, a fixation device, which is usable for fixing the first roller in place relative to the second roller, is actuated in order to maintain the contact pressure permanently.

A device for adjusting the contact pressure between two rollers is known from DE 197 19 305 A1. In the bearing arrangement described there, the adjustably seated roller is pushed against the opposite roller by a spring which is supported on the frame of the printing press. By use of this spring, a defined contact pressure always exists between the two rollers as a function of the respectively selected spring characteristic. A clamping mechanism, with a clamping lever and a clamping plate, is described for fixing the roller in place in the contact position, by the use of which, the roller shaft can be fixed in place against the frame of the printing press by frictional contact.

A device for the semi-automatic adjustment of rollers is known from DE 199 19 733 A1. An adjustably seated roller is maintained in a roller holder, which itself is seated in a frame holder which is arranged fixed in place on the frame. In this case, the roller holder and the frame holder can be displaced with respect to each other and are connected with each other by a spring-elastic assembly. Here the spring-elastic assembly has have a defined pre-tension, so that the roller, which is adjustably seated on the roller holder, can be pressed with a defined contact pressure against the opposite roller. Arresting bolts are provided for arresting the roller holder on the frame holder, because of whose advancement, the roller holder can be clamped with frictional contact to the frame holder.

DE 42 31 873 A1 describes a device for roller adjustment. A roller is initially displaced in the radial direction by the use of a pressure chamber and is subsequently fixed in place.

DD 64 064 describes a device for the fixed clamping of bearing bushes of printing cylinders. No suggestion regarding the adjustment of rollers is provided.

DE 100 01 582 A1 discloses a roller which is displaced by two hydraulic cylinders.

SUMMARY OF THE INVENTION

The object of the present invention is directed to providing devices for adjusting the contact pressure of an adjustably seated roller.

In accordance with the present invention, this object is attained by the provision of at least one actuator which has at least one pressure chamber that can be charged with a pressure medium. Typically, several such pressure chambers are arranged in the circumferential direction of the roller. The actuator may be a pressure proof diaphragm situated in a gap. The actuator may also be a pressure hose. A fixation device, which has multi-disk elements, can fix the positioned roller in place in the radial direction. The actuator is used to push a first roller against a second roller in a web-fed rotary printing press. The roller is held in a roller holder which is displaceably seated on a frame holder.

A particular advantage of the fixation device of the present invention lies in that such a fixation device can be produced in an extremely compact, and therefore space-saving manner. This is achieved in that several multi-disk elements are frictionally clamped for fixing the adjustable components in place relative to each other. By the arrangement of several, and in particular a plurality, of such multi-disk elements one behind the other, the required frictional force is distributed over a plurality of frictional faces between the multi-disk elements. Because of the clamping of the multidisk elements arranged one behind the other, the clamping force acts oppositely on all frictional faces.

Suitable multi-disk elements are known, for example, from multi-disk clutches employed for the frictional connection of rotatably seated shafts. In contrast to the previously known multi-disk clutches, the disks of the fixation device of the present invention can be displaced in respect to each other in at least one direction and, as a function of the play between the components of the fixation device, can be displaced against each other within a defined adjustment range and subsequently can be fixed in place. Thus, the adjustment movement does not take place in the manner of a pivoting or rotational movement, as in the case of the prior art multi-disk clutches, but takes place in the manner of a translatory movement in the plane defined by the orientation of the frictional faces of the multi-disk elements.

Basically all elements, or structures, wherein the disks can be clamped together with the application of a sufficient contact pressure, can be employed as clamping devices. It is particularly advantageous if the clamping device is embodied in the manner of a pre-tensed spring element. A spring force of sufficient strength is exerted by the pre-tensed spring element on the multi-disk elements in the fixed position of the fixation device that they are dependably fixed against each other by frictional contact. Because of this, an unintentional release of the fixation device, for example in case of the loss of power, such as must be feared in connection with other clamping device, is not possible. In order to be able to release the clamping device, for adjusting the components of the fixation device, it is necessary in connection with the present invention to provide an actuating element on the fixation device, by the use of which, the spring element can be pressed together sufficiently far, so that the multi-disk elements can be relaxed and therefore can be displaced in respect to each other.

In principle, any arbitrary drive mechanisms, for example electrically, hydraulically or pneumatically acting systems, can be employed for actuating the spring element. It is particularly advantageous if the actuating element is embodied in the manner of a plunger which is displaceably arranged in a pressure chamber. By charging the pressure chamber with a pressure medium, such as, for example, compressed air or hydraulic fluid, the plunger can be displaced against the spring force of the spring element, so that the multi-disk elements are relaxed.

The advantages to be gained by use of the present invention consist, in particular, in the very compact structure made possible by the disclosed construction. As is known from the prior art, the roller is fastened on a roller holder, which itself is displaceably seated on a frame holder. The frame holder, in turn, can either be fastened fixed in place on the frame of the printing press, or alternatively, it can be arranged on appropriate actuating devices, which are used, for example, for placing the roller seated in the roller holder against or away from the oppositely located roller.

A recess is provided on the roller holder, or on the frame holder, which recess is engaged by a section of the frame holder, or of the roller holder. The dimensions of the section, or of the recess, are selected in such a way that a gap is formed between the recess and the section, by use of which gap the actuating range between the roller holder and the frame holder is defined. The roller holder can be displaced within this gap in respect to the frame holder. To be able to obtain the actuating forces required for the actuating movement, or to be able to press the first roller with a defined contact pressure against the oppositely located roller, at least one actuator is arranged in the gap, which at least one actuator exerts a pulling and/or a pushing force on the roller holder and, in the process, is supported on the frame. Because of the arrangement of the actuator in the gap between the frame holder and the roller holder, it is possible to provide extraordinarily compact structures. In this connection, it is, of course, immaterial whether the recess is provided on the frame holder or on the roller holder, so that, in principle, both constructions are alternatively conceivable.

Basically the configuration of the recess and of the section to be received therein can be arbitrary and can be matched to the respective individual case. Thus, it is conceivable for the recess to be embodied right-angled and only having play, with respect to the section engaging it, in one direction, so that the roller holder can only be displaced in one actuating direction. However, if a displacement of the roller holder in various directions is desired, for example because the roller seated in the roller holder must be placed against several rollers, it is particularly advantageous for the recess and the section to be each embodied as being rotationally symmetrical, so that a circumferential gap is formed between them. Because of this, it is possible for the roller holder to be displaced in an actuating plane in different actuating directions in relation to the frame holder. The actuating range of the actuating movement is thus limited by the width of the circumferential groove.

If the roller holder can be displaced relative to the frame holder in different actuating directions, for example in a total actuating plane, several actuators are required to provide the actuating movement required for this. Therefore, in accordance with a preferred embodiment of the present invention, at least three actuators are arranged in the gap between the roller holder and the frame holder, by use of which at least three actuators the first roller can be pushed in respectively differing directions. By the appropriate selection of the forces exerted by the respective actuators, a force resulting from the combined triggering of the different actuators can be provided in any arbitrary direction on the roller holder, and therefore on the roller seated in the roller holder. In this case, the actuators are preferably arranged, distributed in a star shape, in the gap between the roller holder and the frame holder. If four actuators are arranged opposite each other in the gap, it is possible, because of this, to dependably prevent the tilting of the actuators, since by use of the drive mechanism of one actuator, the respectively oppositely arranged actuator is compressed.

The shape in which the actuators are embodied is, in principle, arbitrary. Electrically, or also piezo-electrically acting systems are therefore also conceivable. It is particularly advantageous for the actuator to be configured in the manner of a pressure-exerting body which can be charged with a pressure medium. If hydraulic fluid is used as the pressure medium, it is possible to provide very high pressures with correspondingly large actuating forces.

In accordance with a preferred embodiment of the present invention, a pretensed gas, and in particular compressed air, is employed as the pressure medium. Since gases are inherently compressible, an elastic spring effect, acting between the frame holder and the roller holder, is the result of the use of a pretensed gas as the pressure medium. It is possible, because of this spring effect, to compensate for mechanical interferences caused, for example, by imbalances or out-of-roundness. Moreover, compressed air is typically available as an energy transfer source in most printing presses.

The device for setting the contact pressure between the displaceably seated roller and an oppositely located roller can also be used for placing the displaceably seated roller into contact with, or out of contact from the other roller. However, for this purpose, it is necessary to select the actuating range between the frame holder and the roller holder to be sufficiently large to be able to perform the actuating movement required for the out-of contact movement. Moreover, it is necessary to select the actuator between the frame holder and the roller holder to be suitable for performing such an actuating movement. To be able to perform the into-contact or out-of-contact movement independently of the actuation of the device, it is advantageous if the device is fastened on an additional out-of-contact device. For example, this out-of-contact device can be embodied in the manner of a pivot arm, by the use of which, the frame holder can be displaced, in relation to the frame of the printing press, between an in-contact position and out-of-contact position.

The compactness of the device in accordance with the present invention can, as a whole, be further increased by situating a fixation device in a device for adjusting the contact pressure between two rollers.

It is particularly advantageous for this purpose if the fixation device extends along the center axis of the device coaxially in respect to the longitudinal axis of the roller which is maintained on the roller holder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
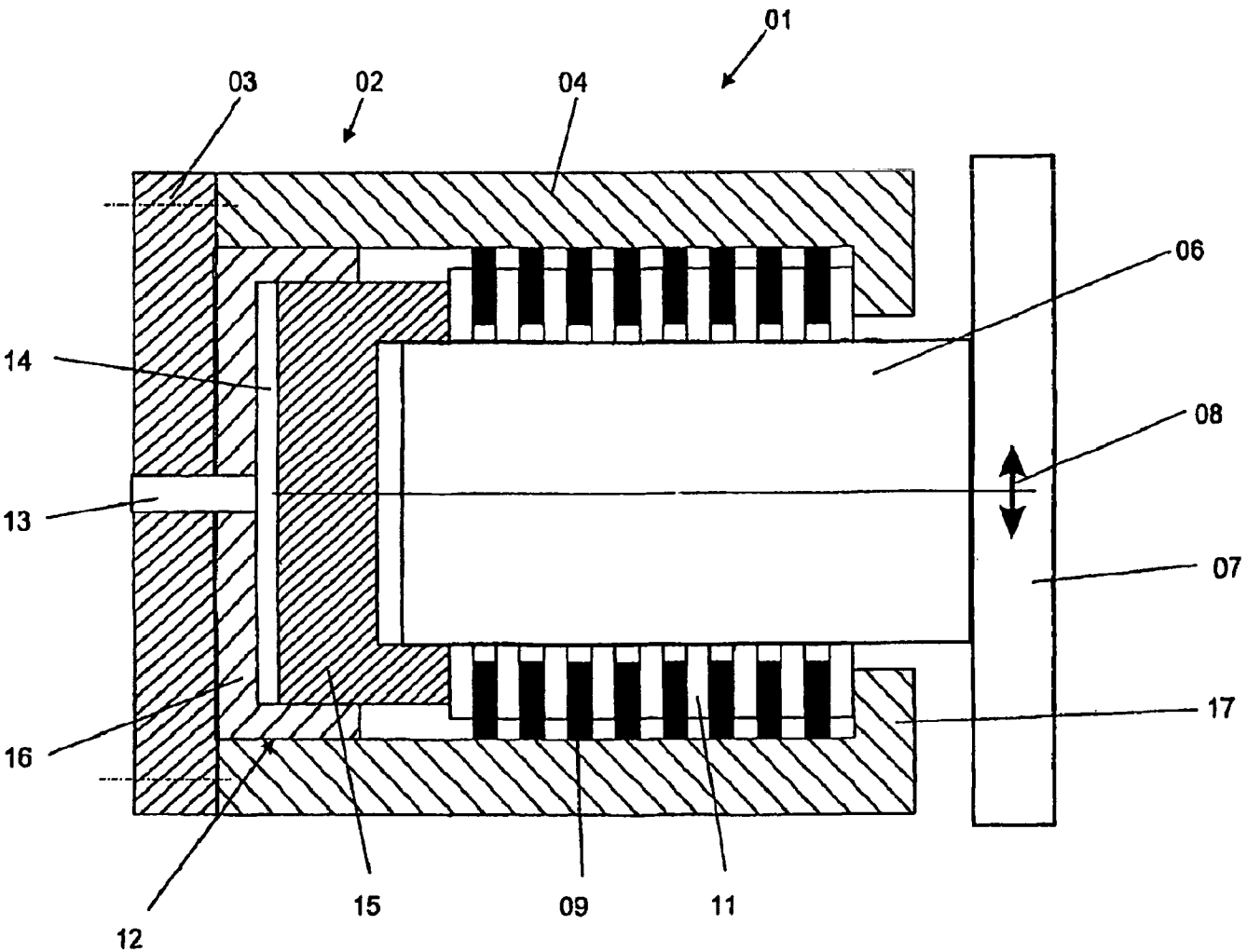
FIG. 1, a schematic side-elevation view of a fixation device in accordance with the present invention, in cross section, in FIG. 2, a schematic side-elevation view of a device for adjusting the contact pressure between two rollers, together with a fixation device, in accordance with the present invention in cross section, in FIG. 3, a schematic end view of the device in accordance with FIG. 2 in a base position, in FIG. 4, a schematic end view of the device in accordance with FIG. 2 in a deflected position, in FIG. 5, a front perspective view of the device in accordance with FIG. 2, and in FIG. 6, a second preferred embodiment of an actuator in accordance with the present invention, in cross section.

Referring initially to FIG. 1, there may be seen a fixation device, generally at 01, in accordance with the present invention. The fixation device 01 represented in FIG. 1 has an element, for example a base body 02 which is formed by a cover 03 and a sleeve 04, and an element which is displaceably seated in the sleeve 04, for example a bolt 06, on whose exterior a fastening plate 07 has been provided. The base body 02 can be fastened to a frame, for example, while a roller lock for seating a roller, for example, can be screwed to the fastening plate 07.

The bolt 06 has a defined radial play with respect to the sleeve 04, so that the bolt 06 can be displaced in relation to the base body 02 in any arbitrary actuating directions 08 in an actuating plane extending perpendicularly with respect to the drawing plane of FIG. 1. Because of this, it is possible to displace the fastening plate 07, for example upward or downward, in the direction of the movement arrow 08. Because of the circularly symmetrical embodiment of the fixation device 01, however, it is also possible to perform actuating movements in other arbitrary directions with respect to the actuating plane. Multi-disk elements 09 are fastened at equidistant spacings on the inside of the sleeve 04 on the base body 02 and mesh with bolt multi-disk elements 11 fastened on the bolt 06. The contact faces between the sleeve multi-disk elements 09, and the bolt multi-disk elements 11 extend in planes which extend parallel with the actuating planes of the possible actuating movements. In the course of displacing the bolt 06 in relation to the base body 02, the sleeve multi-disk elements 09 slide along the bolt multi-disk elements 11, wherein the actuating movement is limited by the play between the bolt 06 and the base body 02.

A clamping device 12, which is provided with a pressure piston 15, which is displaceably seated in a pressure cylinder 16, is provided for fixing the fixation device 01 in a defined position. A pressure chamber 14 can be charged via a connection 13 with a pressure medium, for example hydraulic fluid or compressed air, so that the pressure piston 15 is pushed inside the pressure cylinder 16 in the direction of the sleeve multi-disk elements 09, or the bolt multi-disk elements 11. As a result of this, the multi-disk elements 09, 11 are clamped between the clamping device 12 and an end stop 17 formed on the sleeve 04. As soon as the surface pressure between the pressure piston 15 and the front bolt multi-disk element 11 exceeds a defined pressure, the individual multi-disk elements 09, 11 come into frictional contact with each other, producing a static friction state, so that the bolt 06 is fixed in place relative to the base body 02.

Figure 2:
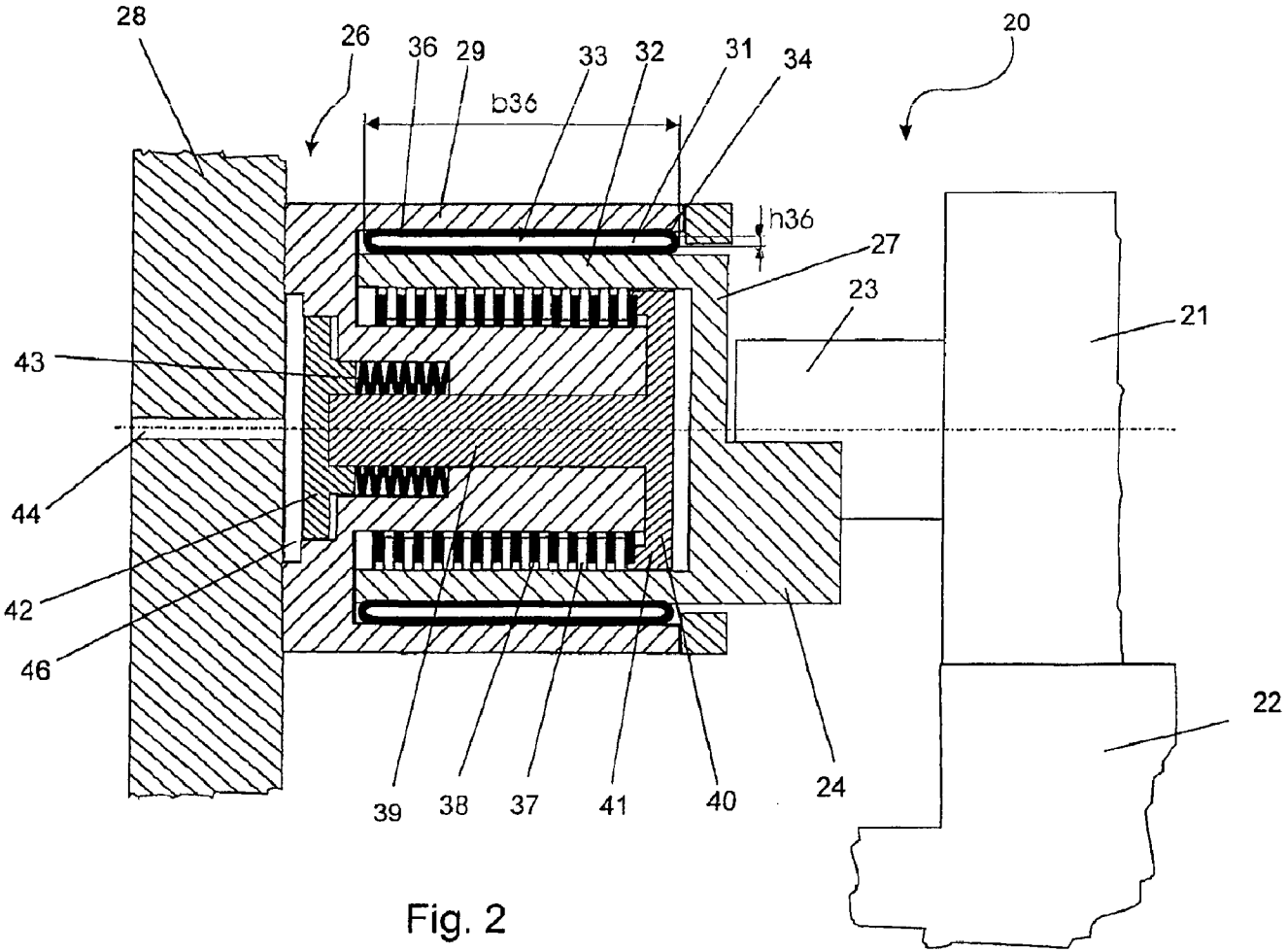

A device 20 for adjusting the contact pressure between a first or movable roller 21 and a second or fixed roller 22 is represented in FIG. 2. The movable roller 21 can be releasably fastened at the ends of its shaft 23 in a quick-release closure 24 provided on the device 20. Such quick-release closures 24 are generally known and have a semicircular-shaped bearing shell into which the ends of the roller shaft 23 can be placed. By fastening an upper bearing shell, which is not specifically represented in FIG. 2, the roller shaft 23 can then be fixed in place in the quick-release closure 24.

The device 20 is essentially constructed utilizing a frame holder 26 and a roller holder 27, which holders can be displaced, in respect to each other, in an actuating plane extending perpendicularly to the drawing plane. The frame holder 26 is constructed from a base plate 28 which, for example, can be pivotably fastened on a frame of a printing press by a pivot arm, and a sleeve body 29. On its side facing the roller 21, the sleeve body 29 has a recess 31, which is engaged by a cylinder-shaped section 32 of the roller holder 27. The inner diameter of the recess 31, or the outer diameter of the section 32, have been selected here in such a way, that a gap 33, which is circularly cylindrical in the base position, of a gap width of approximately 1 mm to 10 mm, and in particular of 2 mm, is formed. The maximum actuating range for displacing the roller holder 27 relative to the frame holder 26 is defined by the gap 33.

To perform the actuating movements required for adjusting the movable roller 21, or to be able to provide the desired contact pressure between the movable roller 21 and the fixed roller 22, a total of four actuators 34, each of which is embodied in the manner of a pressure hose, are arranged distributed over the circumference of the gap 33, only two of which actuators 34 are represented in section in FIG. 2. The pressure chambers 36 constituted by the walls of the actuators 34 can be charged with pressure by feed lines, which are not specifically represented in FIG. 2, but which may be seen at 48 in FIG. 5. A force acts on the roller holder 27 as a function of the respective pressure conditions in the four actuators 34, so that the movable roller 21 can be pressed against the fixed roller 22 with the desired contact pressure by an appropriate control of the pressure in the several actuators 34. Since the air cushion under pressure in the actuators 34 is compressible, it is possible to absorb mechanical interferences by the resultant spring effect.

Figure 5:
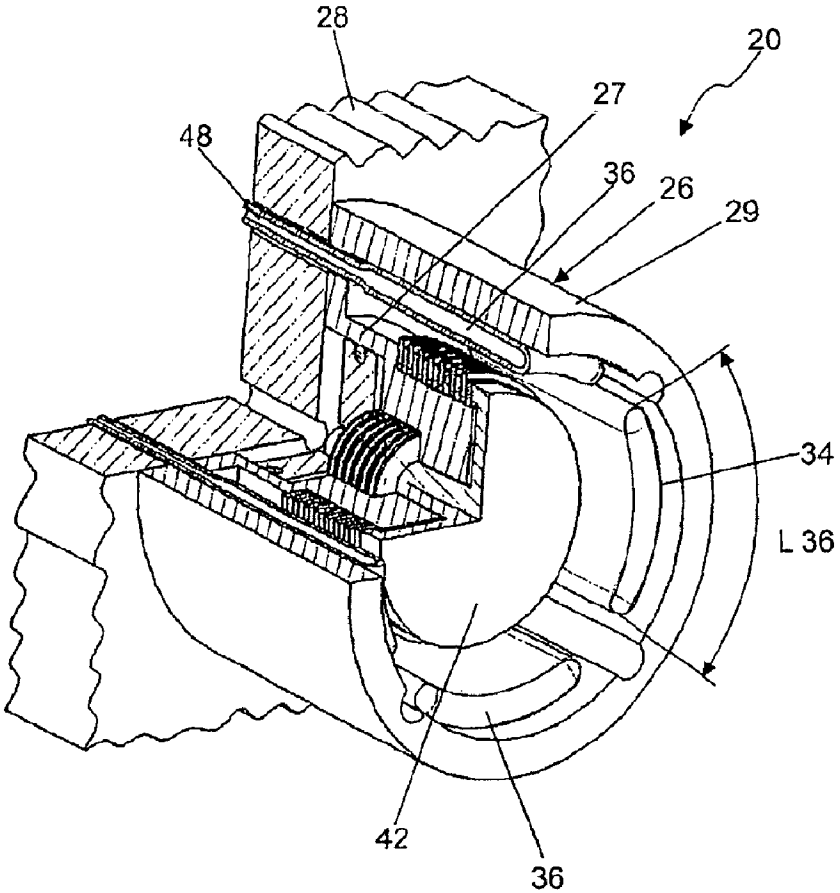

In the contact pressure adjusting device 20, a height h36 of the pressure chamber 36 in the radial direction of the movable roller 21 is less than a width b36 of the pressure chamber 36 in the axial direction of the roller 21, as seen in FIG. 2, and/or of a length l36 of the pressure chamber 36 in the circumferential direction of the roller 21, as seen in FIG. 5.

The ratio of the width b36 and/or the length l36 of the pressure chamber 36 to the height h36 of the pressure chamber 36 is greater than 3, and is preferably greater than 5.

For fixing the roller holder 27 in place relative to the frame holder 26, roller multi-disk elements 37 are fastened on the roller holder 27 and are arranged so they mesh with sleeve multi-disk elements 38 fastened on the sleeve body 29, and cooperate with each other for forming a multi-disk packet. A piston 39, which is T-shaped in cross section, is provided for the frictionally connected clamping of the multi-disk packet formed by the multi-disk elements 37 and 38, and whose circular piston head 40 comes to rest with a circular ring-shaped flange 41 against the outermost sleeve multi-disk element 38 of the multi-disk packet. A pressure plate 42 is fastened to the opposite end of the piston 39, on which pressure plate a spring force, which is a function of a spring element 43, and which is embodied in the manner of a plate spring packet, acts. The spring element 41 is pre-stressed and is mounted between the pressure plate 42 and the sleeve body 29, so that the multi-disk packet, constituted by the multi-disk elements 37, 38, is clamped by the spring force which is transmitted by the piston 39 to the multi-disk elements 37, 38.

For displacing the roller holder 27 relative to the frame holder 26, in particular when adjusting the contact pressure between the rollers 21, 22, it is necessary to release the fixation device that is constituted by the multi-disk elements 37, 38, or by the piston 39 and the pressure plate 42. A pressure connector 44 is provided in the base plate 28 for this purpose, and through which a pressure chamber 46 between the pressure plate 42 and the base plate 28 can be charged with a pressure medium, for example compressed air. As soon as the air pressure acting on the pressure plate 42 exceeds the spring force of the spring element 43, the piston 39 is lifted off the outermost sleeve multi-disk element 38 so that the latter are no longer frictionally clamped and can be displaced relative to each other.

Adjusting the contact pressure between the rollers 21, 22 takes place in the following manner, for example. First, the pressure chamber 46 is charged with sufficient pressure so that the multi-disk elements 37, 38 are no longer frictionally clamped. Subsequently, each of the actuators 34 is charged with an amount of pressure just sufficient so that the desired contact pressure between the rollers 21, 22, or between the roller 21 and further rollers, which are not represented in FIG. 2, is achieved and results in a contact strip of the desired width. As soon as the correct setting at the desired contact pressure between the rollers 21, 21 has been achieved, the pressure in the pressure chamber 46 is released, so that the piston 39 clamps the multi-disk elements 37, 38 against each other, so that the roller holder 27 is fixed in place in the desired position relative to the frame holder 26. At the end of the adjustment procedure, the pressure in the actuators 34 is released.

Figure 3:
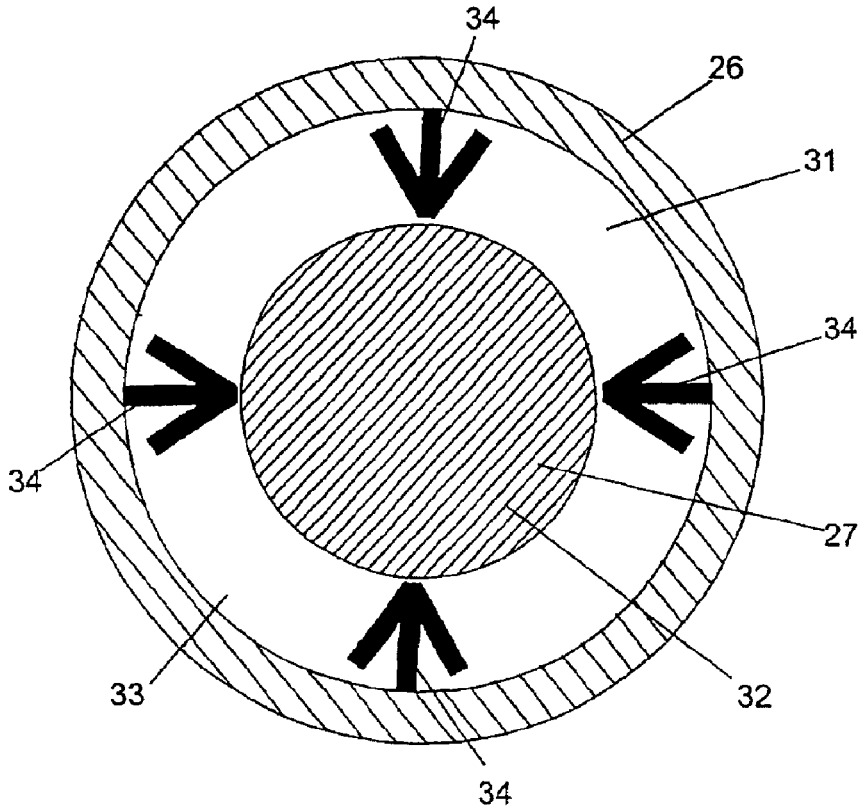
Figure 4:
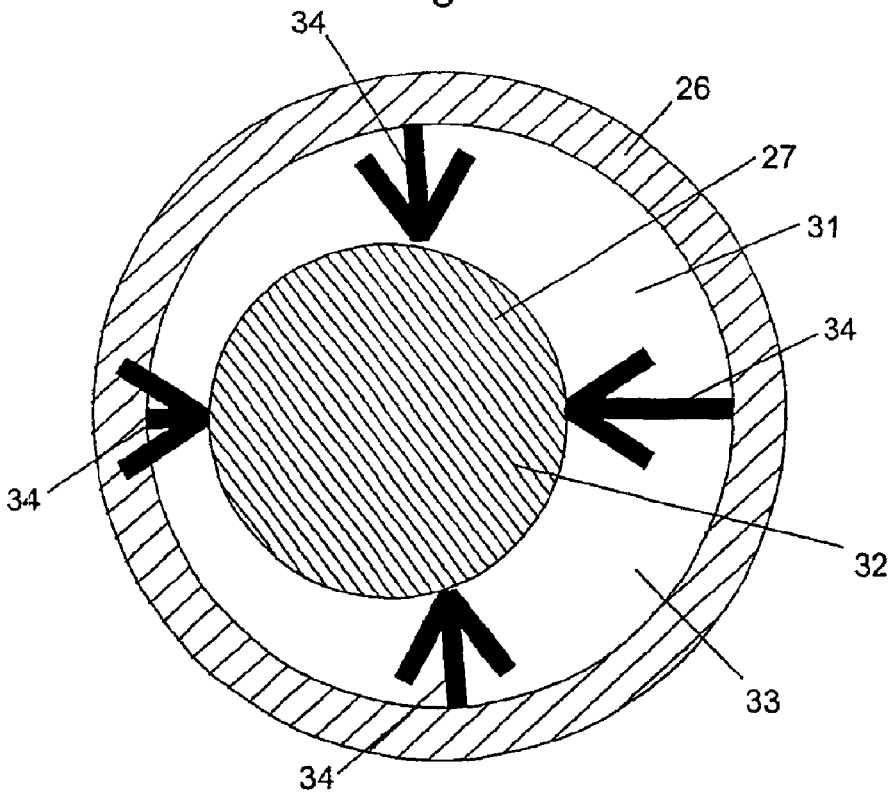

The functional principle of operation the contact pressure adjusting device 20, during the required actuating movement, is schematically represented in FIGS. 3 and 4. FIG. 3 shows the frame holder 26 with the recess 31, and the section 32 of the roller holder 27 engaging it. By properly selecting the dimensions, a gap 33 is formed between the frame holder 26 and the section 32 of the roller holder 27, in which gap 23 the actuators 34 are arranged, which actuators 34 are schematically indicated in FIGS. 3 and 4 by force arrows. The possible actuating movements between the frame holder 26 and the roller holder 27 are defined by the actuating plane, which extends in the drawing plane in the representation of FIG. 3 and FIG. 4, wherein the actuating range of the actuating movements is limited by the width of the gap 33.

As represented in FIG. 4 by way of example, the roller holder 27 and, as a result the roller 21 fastened on it, can be laterally displaced relative to the frame holder 26, which lateral displacement is caused by an appropriate control of the actuators 34 and the resultant force effect on the section 32. As soon as the desired position of the roller holder 27, relative to the frame holder 26, has been achieved, the fixation device constituted by the multi-disk elements 37, 38, or by the piston 39 and the pressure plate 42, can be activated, so that the position of the roller holder 27 is permanently fixed and the actuators 34 need no longer be operated.

FIG. 5 shows the contact pressure adjusting device 20 having the base plate 28, the frame holder 26, the roller holder 27 and the actuators 34, in a perspective view from the front. The four actuators 34, which are embodied in the manner of pressure hoses, and which can be charged with compressed air via supply lines 48, are arranged between the sleeve body 29 of the frame holder 26 and the roller holder 27, on whose frontward oriented side the quick-release closure 24 in the shape of a half shell can be partially seen. The multi-disk elements 37, 38, not visible here, can be relaxed by means of the pressure plate 42. The extraordinarily compact construction of the device 20 can be noticed which, because of its wholly rotationally symmetrical embodiment, with the exception of the base plate 28, has a lesser diameter than the roller 21 itself, as can be seen in FIG. 2.

Figure 6:
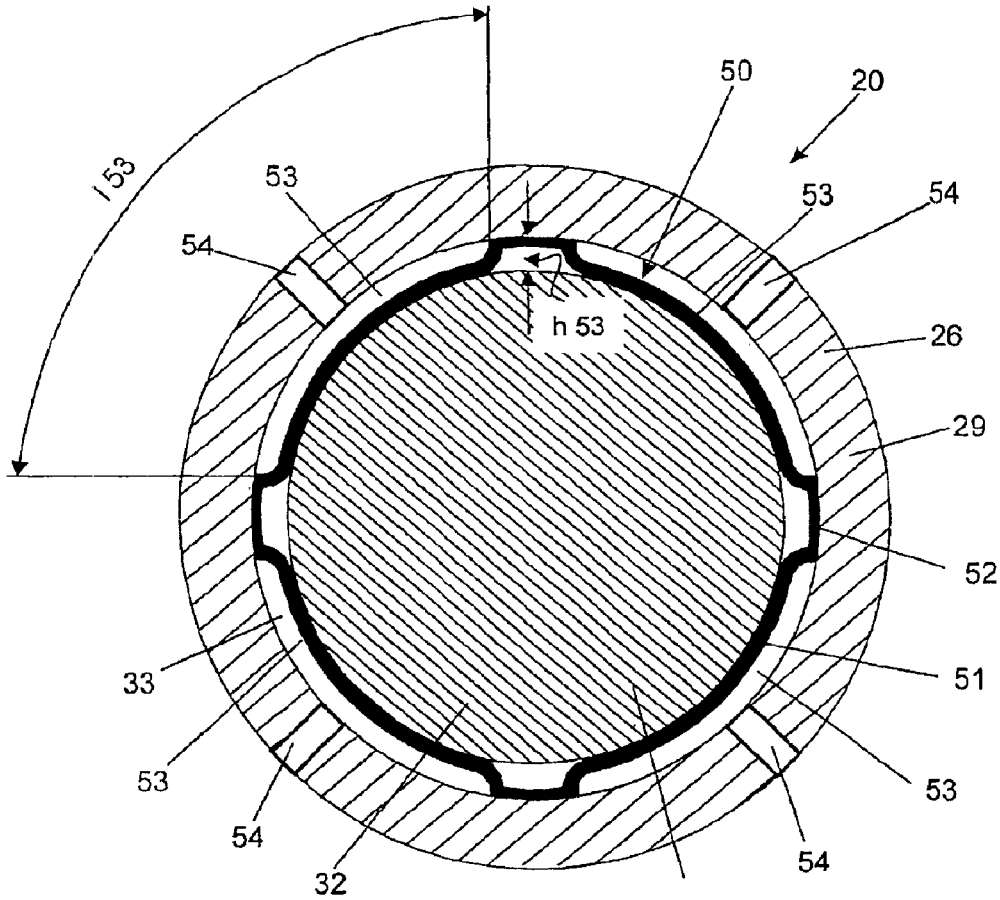

FIG. 6 shows a second preferred embodiment, at 50, of an actuator 50 for a contact pressure adjusting device 20 in cross section. The principal configuration of the device 20 with the frame holder 26, the roller holder 27 and the fixation device for fixing the roller holder 27 relative to the frame holder 26 corresponds to the configuration described in FIG. 2 and therefore need not be further described. A cylinder-shaped diaphragm 51, whose upper and lower edges are connected with the inner diameter of the sleeve body 29 (not represented in FIG. 6), is arranged in the gap 33 for constituting the actuator 50. The diaphragm is furthermore connected with the inner diameter of the sleeve body 29 in four strip-shaped areas 52, for example by being glued to it, so that four pressure chambers 53 are formed by the sleeve body 29 and the diaphragm 53 as the result, which four pressure chambers 53 are evenly distributed over the circumference of the gap 33. Each of the pressure chambers 53 can be charged with compressed air via pressure inlet openings 54 so that, as a function of the respective pressure in the four pressure chambers 53, a resultant force acts on the section 32 of the roller holder 27.

The height h53 of the pressure chamber 53 of the contact pressure adjusting device 20 in the radial direction of the roller 21 is less than the width of the pressure chamber 53 in the axial direction of the roller 21 and/or the length l53 of the pressure chamber 53 in the circumferential direction of the roller 21.

The ratio of the width b53 and/or the length l53 of the pressure chamber 53 to the height h53 of the pressure chamber 53 is greater than 3, and in particular is greater than 5.

While preferred embodiments of devices for adjusting the contact pressure of an adjustably mounted cylinder, in accordance with the present invention, have been set forth fully and completely hereinabove, it will be apparent to one of skill in the art that various changes in, for example the specific source of the fluid under pressure, the type of printing press with which the devices are used and the like could be made without departing from the true spirit and scope of the present invention which is accordingly to be limited only by the appended claims.

What is claimed:

1. A device for adjusting a position of a displaceable roller comprising:

a roller holder, said roller holder being located exteriorly of, and supporting a roller whose position is to be adjusted;

a frame holder supporting said roller holder, said roller holder being displaceable with respect to said frame holder;

a circumferential gap formed between said roller holder and said frame holder;

an actuator in said circumferential gap, said actuator including a plurality of pressure chambers arranged in said gap and acting in a circumferential direction of said roller, at least two of said pressure chambers adjoining each other and not being opposite to each other in said circumferential direction, said at least two of said pressure chambers acting in different directions; and means for charging a fluid under pressure to said actuator.

2. The device of claim 1 wherein at least two of said pressure chambers are actuated independently of each other.

3. The device of claim 1 wherein each said pressure chamber has a height in a radial direction of said roller, a width in an axial direction of said roller and a length in a circumferential direction of said roller, said height being less than said width and said length.

4. The device of claim 3 wherein each said pressure chamber is a pressure hose.

5. The device of claim 3 wherein a ratio of one of said width and said length to said height is greater than three.

6. The device of claim 1 wherein each said pressure chamber is a pressure hose.

7. The device of claim 6 wherein each said pressure hose can be operated independently.

8. The device of claim 1 wherein there are at least three of said pressure chambers.

9. The device of claim 1 wherein there are at least four of said pressure chambers.

10. The device of claim 1 wherein said roller is one of an inking roller and a dampening roller of a printing press.

11. The device of claim 1 wherein said actuator places said roller against or away from a cooperating roller.

12. The device of claim 1 further including a fixation device.

13. The device of claim 12 wherein said fixation device is a clamping device.

14. The device of claim 12 wherein said fixation device extends coaxially to a longitudinal axis of said roller and is arranged about a central axis of said device.

15. The device of claim 12 wherein said fixation device includes at least three multi-disk elements having frictional faces, said frictional faces being perpendicular to an axis of rotation of said roller.

16. The device of claim 1 wherein said frame holder is a housing forming said gap.

17. The device of claim 1 wherein said frame holder has a first radial size and said adjustable roller has a second radial size, said first radial size being less than said second radial size.

18. A device for adjusting a position of a displaceable roller comprising:

a roller holder, said roller holder being located exteriorly of, and supporting a roller whose position is to be adjusted;

a frame holder supporting said roller holder, said roller holder being displaceable with respect to said frame holder;

a circumferential gap between said roller holder and said frame holder;

an actuator in said circumferential gap, said actuator including a plurality, of pressure chambers arranged in said circumferential gap and acting in a circumferential direction of said roller, said actuator being defined by a pressure-proof diaphragm engaging a wall of said roller holder and a wall of said frame holder, said diaphragm and said wall of said frame holder being connected in pressure-proof manner in a fastening sections and forming a plurality of pressure chambers, at least two of said pressure chambers adjoining each other and not being opposite to each other in said circumferential direction, said at least two of said pressure chambers acting in different directions.

19. The device of claim 18 wherein there are at least three of said pressure chambers.

20. The device of claim 18 wherein there are at least four of said pressure.

21. The device of claim 18 wherein said roller is one of an inking roller and a dampening roller of a printing press.

22. The device of claim 18 wherein said actuator places said roller against or away from a cooperating roller.

23. The device of claim 18 wherein said frame holder has a firsr radial size and said adjustable roller has a second radial size, said first radial size being less than said second radial size.

24. The device of claim 18 wherein said frame holder is a housing forming said gap.

25. The new device of claim 18 further including a fixation device.

26. The device of claim 25 wherein said fixation device is a clamping device.

27. The device of claim 25 wherein said fixation device extends coaxially to a longitudinal axis of said roller and is arranged about a central axis of said device.

28. The device of claim 25 wherein said fixation devices includes at least three multi-disk elements having frictional faces, said frictional faces being perpendicular to an axis of rotation of said roller.

29. A device for adjusting a position of a displaceable roller comprising:

a roller holder, said roller holder being located exteriorly of, and supporting a roller whose position to be adjusted;

a frame holder supporting said roller holder, said roller holder being displaceable with respect to said frame holder;

a cirumferential gap between said roller holder and said frame holder;

an actuator in said circumferential gap, said actuator including a plurality of pressure chambers arranged in said gap and acting in a circumferential direction of said roller, forces of adjoining ones of said plurality of pressure chambers being at right angles to each other; and means for charging a fluid under pressure to said actuator.

30. A device for adjusting a position of a displaceable roller comprising:

a roller holder, said roller holder being located exteriorly of, and supporting a roller whose position to be adjusted;

a frame holder supporting said roller holder, said roller holder being displaceable with respect to said frame holder;

a circumferential gap between said roller holder and said frame holder;

an actuator in said circumferential gap, said actuator including a plurality of pressure chambers arranged in said gap and acting in a circumferential direction of said roller, said plurality of pressure chambers being arranged in a star shape; and means for charging a fluid under pressure to said actuator.

* * * * *